United States Patent [19]

Maclin

[11] Patent Number: 4,912,922

[45] Date of Patent: Apr. 3, 1990

[54] COMBUSTION CHAMBER CONSTRUCTION

[75] Inventor: Harvey M. Maclin, Cincinnati, Ohio

[73] Assignee: General Electric Company, Cincinnati, Ohio

[21] Appl. No.: 316,441

[22] Filed: Dec. 19, 1972

[51] Int. Cl.[4] ..... F23R 3/60

[52] U.S. Cl. ..... 60/39.32; 60/757

[58] Field of Search ..... 60/39.65, 39.69, 39.31, 60/39.32, 752, 755, 757

[56] References Cited

U.S. PATENT DOCUMENTS

| | | | |
|---|---|---|---|
| 2,268,464 | 12/1941 | Seippel | 60/39.65 |
| 2,617,255 | 11/1952 | Hiehus | 60/39.65 |
| 2,702,987 | 3/1955 | Nicolin | 60/39.65 |
| 2,778,192 | 1/1957 | Kroon | 60/755 |
| 3,186,168 | 6/1965 | Ormerod et al. | 60/39.32 |
| 3,672,162 | 6/1972 | Rygelis et al. | 60/39.65 |

*Primary Examiner*—Stephen C. Bentley

*Attorney, Agent, or Firm*—Jerome C. Squillaro; Steven J. Rosen

[57] ABSTRACT

A combustion chamber for use in gas turbine engines is provided with a liner formed of a high temperature material. The liner includes a plurality of annular rings of high temperature material mounted by means of flexible mounting arrangement upon a high strength structural frame. As a result of this mounting arrangement, the liner is substantially isolated from structural forces associated with the combustion chamber, while the frame is substantially isolated from thermal stresses associated with the liner. The individual liner rings may be easily removed for repair or replacement without disassembling the frame and associated components. Furthermore, the "decoupling" of thermal and structural stresses provides longer life and more dependable operation.

5 Claims, 2 Drawing Sheets

COMBUSTION CHAMBER CONSTRUCTION

Related to this application are co-pending and concurrently filed cases Ser. No. 316,530, Ser. No. 316,531, now U.S. Pat. No. 4,480,436, and Ser. No. 316,532, all filed on Dec. 19, 1972 and assigned to the same assignee as the present application.

BACKGROUND OF THE INVENTION

The invention herein described was made in the course of or under a contract or a subcontract thereunder with the United States Department of the Air Force.

This invention relates to gas turbine engines and, more particularly, to combustion chambers for use therein.

Gas turbine engine efficiency is a function of various parameters, among them the temperature achievable within combustion chambers, as well as the amount of air which must be diverted to cool various elements of the engine. Contemporaneously, the structural integrity of an engine is improved if structural loads are carried by elements of the engine which elements are not also subjected to high temperatures and attendant thermal stresses.

In an attempt to raise achievable temperatures within combustion chambers, various materials and alloys have been proposed for use in the construction of the chambers. Two materials which exhibit particularly beneficial resistance to thermal effects are oxide dispersion strengthened materials and various ceramics. Another beneficial material involves a high temperature coating of columbium. A major drawback with respect to the former materials and certain others, however, is that they are difficult or impractical to weld. The inventions disclosed within individuals of the cited patent applications make possible the use of such materials in the construction of combustion chambers. The present invention is particularly adapted to the use of columbium coatings in combustion chambers; however, the concepts hereof are broadly applicable.

The effective application of such high temperature materials as those discussed, in addition to enabling higher temperatures to be reached, also allows a reduction in the amount of cooling fluid required to be directed to the combustion chamber during operation. This reduction enables the engine to operate with increased efficiency.

Structural failures in gas turbine engines in the past have sometimes resulted from the subjection of structural load bearing portions of the engine to thermal stresses associated with high temperatures of combustion. The formation of a combustion chamber in a way which requires the combustion chamber (which is directly exposed to the heat of combustion) to carry structural loads associated with the liner has sometimes resulted in such failures. Use of the configuration of the present invention overcomes these problems by isolating the liner of the chamber from the structural loads associated with the frame encircling the chamber.

Another significant facet of the present invention is that it permits the easy removal of individual liner rings without the necessity of total disassembly of the structural frame and associated components. This, in turn, permits the substitution of new rings for those which may have become worn over extended use, or the repair of individual liner rings which retain a useful life. Such a capability proves a great cost saving with respect to prior art devices wherein combustion chambers have been formed of a substantially unitized construction and wherein damage or wear to a single portion of the chamber has necessitated replacement of large sections or the entirety thereof.

SUMMARY OF THE INVENTION

It is, therefore, a primary object of the present invention to provide a combustion chamber for use in gas turbine engines which provides improved structural integrity by supplying independent members for subjection respectively to thermal and structural stresses associated with combustion chambers.

It is another object of the present invention to provide a combustion chamber for use in gas turbine engines wherein an improved liner formed of a plurality of rings provides easy and effective repair and replacement capabilities and wherein improved liner materials can be utilized without the drawbacks of conventional fabrication.

These objects, and others, which will become apparent from the detailed description hereinafter, are accomplished by the present invention, in one form thereof, by means of the use of a liner formed of a plurality of annular rings. The rings cooperate with one another telescopically and with an encircling structural frame in a resilient cooperation facilitated by associated spring members and retaining means comprising a protrusion and detent combination. In one form thereof, the spring means comprise generally U-shaped, cross-sectional resilient members carrying the protrusion upon one of the legs of the U, the second leg cooperating with the associated ring. Axially adjacent liner rings stack upon one another with the immediately downstream rings sandwiched at their leading edges between the legs of the U-shaped resilient member.

BRIEF DESCRIPTION OF THE DRAWINGS

The present invention is more particularly described in connection with the following drawings, wherein.

DESCRIPTION OF A PREFERRED EMBODIMENT

Figure 1:
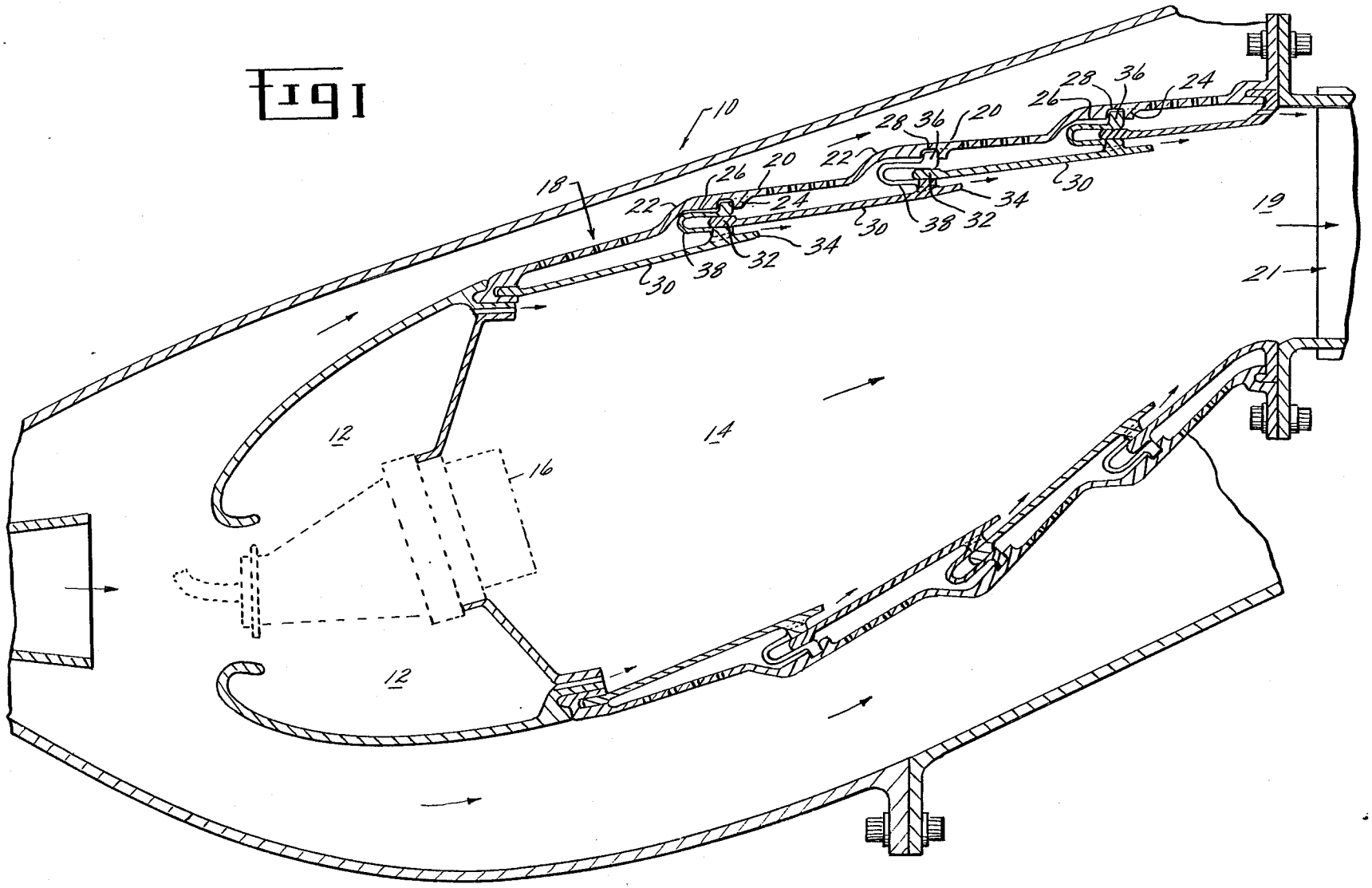
FIG. 1 is a simplified, cross-sectional view of a combustion chamber of a gas turbine engine according to the present invention.

The combustion chamber depicted in FIG. 1 illustrates the basic elements of this portion of typical turbomachinery of its variety, as well as the substantial improvements characteristic of the present invention. As is well known in the art, atmospheric air enters the combustion chamber, designated generally as 10, from the left through a fuel/air inlet 12 downstream of a high pressure compressor (not shown). The combustion chamber defines a combustion zone 14 and includes a fuel nozzle 16 disposed within inlet 12. A high strength structural frame 18 including a backing piece 20 circumscribes the combustion zone 14. In the typical fashion, fuel from nozzle 16 and air entering through the inlet 12 are mixed within combustion zone 14 wherein burning occurs. The products of combustion are expelled to the right in FIG. 1 through an outlet 19 and across a row of turbine blades 21. The turbine blades extract energy from the exiting products of combustion and serve to operate a rotatable shaft which powers the upstream compressor. The remaining issuing flow of products of combustion produces a thrust to the left in FIG. 1.

The structure of the combustion chamber, according to the present invention, is more particularly disclosed with reference to the remaining figures. The frame 18 including backing piece 20 can be seen to gradually increase in radius with axially spaced radial steps 22 as well as a gradual taper from the upstream end toward the downstream end of the combustion chamber. Each step is associated with a pair of circumferentially extending shoulders 24 and 26 defining therebetween a substantially circumferentially extending slot 28. The slot provides a detent member as will be described hereinafter for retention of combustion chamber members.

According to a major object of the present invention, a plurality of individual combustion liner rings 30 are provided, which rings cooperate with the structural frame 18 to complete the configuration of the combustion chamber. In order to facilitate the disposition of liner rings 30 about the structural frame, mounting means for positioning and securing the rings with respect to the frame are provided. The mounting means includes the slot or detent 28 introduced hereinabove. In addition, in the form of the invention depicted in FIG. 3, each panel includes a leading edge 32 and a trailing edge 34 and carries a substantially radially extending protrursion 36 for cooperating with the detent 28. Together, the protrusion 36 and detent 28 combine to provide a retaining means for cooperating with the frame to maintain ring position.

Figure 3:
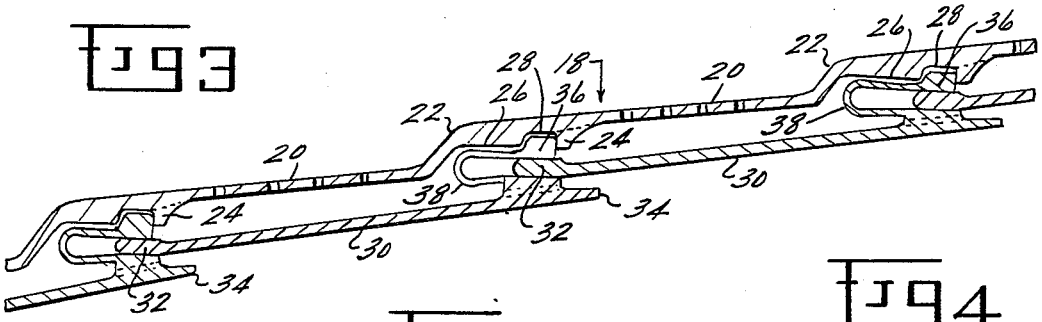
FIG. 3 illustrates the cooperation between liner rings of the first embodiment of the present invention with one another and with the structural frame.

Additionally, the mounting means includes a flexible member, including spring 38 in FIG. 3. Together, the retaining means and the flexible means combine to retain the rings within a substantially predetermined position with respect to the frame 18 during operation of the combustion chamber.

Structurally, the protrusion 36 can be disposed upon one leg of the generally U-shaped, cross-sectional spring means 38, the second leg being rigidly attached to a ring 30 near its trailing edge 34. When an individual ring is brought into position with respect to frame 18, the associated spring 38 is deflected or preloaded with protrusion 36 being moved radially toward the associated ring until the protrusion occupies detent 28 whereupon it snaps ito a retaining position with respect thereto.

Axially, cooperation between adjacent rings 30 is such that a plurality of the rings stack up telescopically to define the combustion zone 14. In the embodiment of FIG. 3, the axial cooperation is such that the leading edge 32 of each downstream ring 30 is received and retained by the trailing edge 34 of an upstream ring by means of sandwiching cooperation of the leading edge between the two legs of the generally U-shaped, cross-sectional resilient spring member 38. In other words, the leading edge of each downstream ring projects between the two legs of the U-shaped resilient member 38 and is retained within the space defined therebetween.

Figure 2:
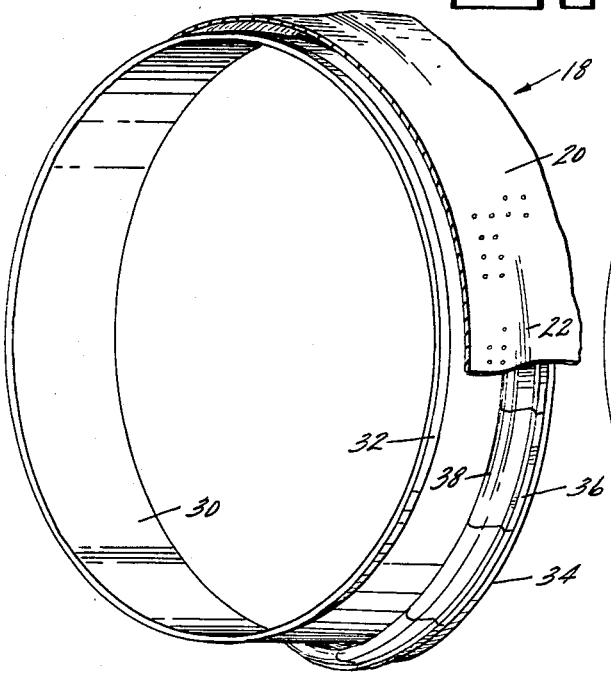
FIG. 2 is a pictorial representation of a single liner ring according to a first embodiment of the present invention and illustrating its cooperation with a portion of the structural frame.

As can be seen from FIGS. 2 and 3, the protrusions 36 and slots 28 extend substantially circumferentially of the rings and of the frame respectively. Furtheremore, each ring includes a spring 38 and protrusion 36 combination, and the frame 18 includes a spaced plurality of detents 28. Hence, in similar fashion to that described above, a plurality of liner rings 30 can be brought into position and retained. According to a major objective of the present invention, the mounting procedure described can be reversed in order to provide for easy removability of the individual liner rings, should they become worn or damaged due to extended use. Thus, the present invention makes possible the reasonably inexpensive maintenance of viable combustion chamber liner.

The overall operation of the combustion chamber has already been described. Relating that operation to the function of the present invention, the aerodynamic and thermal effects upon the combustion chamber liner can be considered. Aerodynamically, terrific gas velocities are achieved within the combustion zone 14 due to the great expansion of the gases burned therein. Hence, large static and dynamic pressures are exerted upon the individual rings 30. These pressures are transferred directly to the structural frame 18 which serves to bear the brunt of the mechanical forces associated with the combustion chamber.

Thermally, the gases burning within combustion zone 14 achieve extremely high temperatures, and the individual liner rings 30 are directly subjected to these temperatures. (Cooling of the rings may be by means of combined impingement cooling of the radially outward ring sides and film barrier cooling of the sides of the rings bordering combustion zone 14. Alternative cooling systems may be utilized, however, the thermal impact upon the cooling rings is extremely great.) To alleviate this situation, the present invention provides for the possible utilization of coated columbium materials which exhibit beneficial thermal characteristics.

It is an unfortunate characteristic of many high temperature materials that they are not suitable for bearing structural loads. By the present invention, the individual liner rings 30 are not required to withstand structural forces, these being transmitted directly to frame 18. Similarly, the materials of frame 18, high strength materials, would not necessarily be appropriate for exposure to the heat of combustion within zone 14. By means of the present invention, the structural frame 18 is not directly exposed to high temperatures, but rather separated therefrom by rings 30. Hence, as a result of this invention, high strength and high temperature materials can be applied to mechanically and thermally stressed areas without adverseley affecting one another.

It is a characteristic of columbium coated materials, appropriate for the present invention, that they exhibit low coefficients of thermal expansion. The corresponding coefficient of the frame material could be substantially higher. Hence, during transient combustion chamber operation, the thermal expansion of the rings 30 and frame 18 could be fairly effectively matched with one another so that mechanical or hoop stress associated with expansion of the rings 30 would not be an adverse influence upon frame 18. In order to further isolate the frame from mechanical stresses associated with thermal influence upon rings 30, the described mounting means is well suited.

To this end, fabrication of liner rings 30 upon frame 18 results in the plurality of telescoping rings, each of which is spaced from the frame. The rings are maintained in this spaced relationship at the leading edge by the cooperation of leading edge 32 with the trailing edge 34 of the axially adjacent upstream ring. The trailing edge of each ring is maintained a predetermined distance from the frame by means of the resilient spring member 38. Thermal expansion of an individual ring 30 causes the ring to bear against and flex the spring 38 thereby allowing adjustments of the radial position of ring 30 with respect to frame 18. Therefore, the effect of mechanical forces upon frame 18 from rings 30 is substantially reduced. Similarly, if structural forces cause deflection of frame 18, this deflection is not transmitted to the rings 30 directly but rather is absorbed in part by flexing of the resilient spring members 38.

Forces which tend to dislodge rings from their axial position with respect to frame 18 are counteracted and withstood by means of the retaining means, including protrusion 36 and slot 28. Therefore, as a result of the utilization of the present invention, a combustion chamber can be formed of individual, substantially annular rings securely retained both axially and radially within predetermined position. The rings are capable of being formed of appropriately high temperature material, even though this material might be impractical to weld or otherwise fabricate. Furthermore, the rings are held reliably in position by means of a retainer and a flexible radial mounting means.

Figure 4:
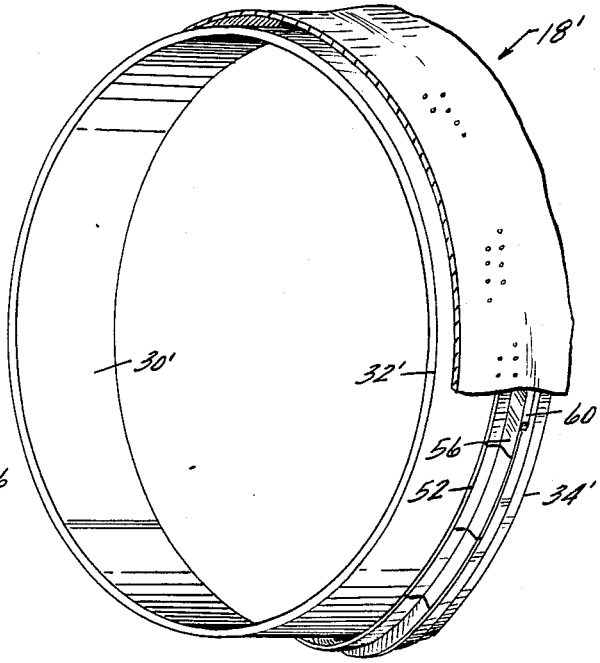
FIG. 4 is a pictorial representation of a single liner ring according to a second embodiment of the present invention illustrating its cooperation with the structural frame.
Figure 5:
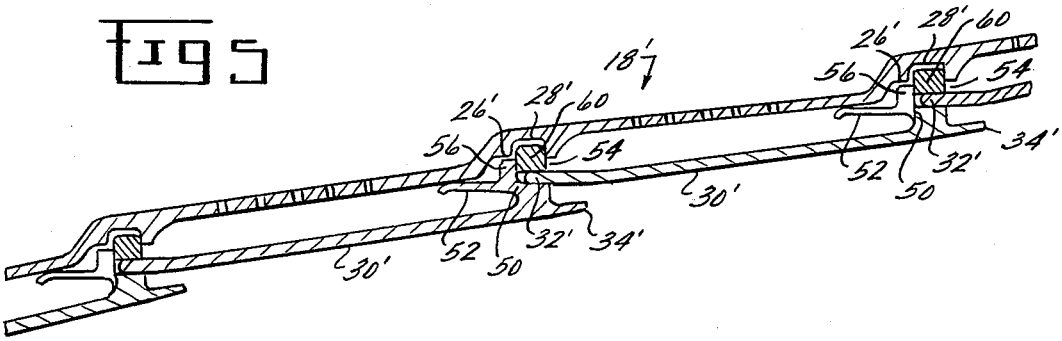
FIG. 5 is a cross-sectional view of a liner similar to that of the second embodiment (of FIG. 4), illustrating its cooperation with adjacent rings and with the structural frame.

Another embodiment of the present invention is depicted in FIGS. 4 and 5. The structure of this embodiment is different from that described with respect to the first embodiment; however, its operation is substantially similar. A frame 18' is provided with shoulders 24' and 26' defining a detent 28'. Substantially annular rings 30' carry spring means 50 in the form of substantially finger-like resilient members 52 which extend between individuals of the rings 30' and the frame 18'. The spring means are carried proximate the trailing edges 34' of the rings and operate to separate the trailing edges by a predetermined space 54 from the frame. These finger-like springs operate to flex and absorb variations in radial ring position with respect to the frame similarly to the U-shaped springs above. In addition, the trailing edges 34' of the rings cooperate with leading edges 32' of downstream rings in order to accept these leading edges within the spaces 54 and retain them therein.

In order to position the rings 30' axially with respect to the frame means, each spring means includes a substantially radial shoulder 56 which projects in substantially the same direction as frame shoulder 26'. Into the slot 28' is placed a retaining band 60 which serves to block axial movement of shoulder 56 with respect to shoulder 24' of the frame upon which the band also bears. During the fabrication of the combustion chamber, individual fingers 52 of the spring means 50 are flexed or preloaded. Furthermore, during operation of the combustion chamber, these fingers are further flexed as thermal and mechanical stresses force compensating spatial adjustments between rings 30' and frame 18'. This embodiment of the present invention also permits substantial isolation of the frame 18' from thermal stresses associated with rings 30', and likewise isolate rings 30' from structural stresses associated with frame 18'.

Also, the fabrication of the combustion chamber is easily reversible whereby the individual rings 30' may be withdrawn from their cooperation with frame 18' by removing retaining band 60 and reversing fabrication.

Having thus described a preferred embodiment of the present invention, this specification concludes with a number of claims directed toward the present invention. It will be apparent to those skilled in the art that substantial variations of the structure disclosed herein may be made without departing from the spirit of the present invention. For example, the spring members and retaining means may be comprised of any number of structural configurations serving equally well the purposes disclosed herein. These and other such variations are intended to be incorporated as part of the present invention.

What is claimed as new and sought to be secured by Letters Patent of the United States is:

1. A combustion chamber for use in a gas turbine engine, the chamber comprising:

an inlet for receiving air and fuel to be burned;

an outlet for expelling products of combustion;

high strength structural frame means disposed between the inlet and outlet for supporting mechanical forces associated with the chamber;

liner means structurally independent of said frame and cooperating with the frame to define a combustion zone, said liner means including a plurality of continuous annular rings adjacent to each other;

means for positioning at least one of said rings including flexible means carried by said ring and retaining means for cooperating with said flexible means to retain said ring substantially within a predetermined position with respect to

2. The combustion chamber of claim 1 wherein said resilient member extends substantially circumferentially of the associated ring, and the detent includes a slot extending substantially circumferentially of the frame means.

3. A combustion chamber for use in a gas turbine engine, the chamber comprising:

an inlet for receiving air and fuel to be burned;

an outlet for expelling products of combustion;

high strength structural frame means disposed between the inlet and outlet for supporting mechanical forces associated with the chamber;

liner means structurally independent of said frame and cooperating with the frame to define a combustion zone, said liner means including a plurality of continuous annular rings adjacent to each other;

mounting means for positioning said rings substantially within a predetermined position with respect to said frame during operation of the chamber including protrusions, detents carried by said frame for accepting said protrusions, a generally U-shaped resilient member, the protrusions occupying one of the legs of the U and an associated ring cooperating with the other leg of the U, the leading edge of the axially adjacent ring projecting between the legs of the U.

4. The combustion chamber of claim 3 wherein the U-shaped resilient member extends substantially circumferentially of the associated ring, and the detent includes a slot extending substantially circumferentially of said frame means.

5. A combustion chamber for use in a gas turbine engine, the chamber comprising:

an inlet for receiving air and fuel to be burned;

an outlet for expelling products of combustion;

high strength structural frame means disposed between the inlet and outlet for supporting mechanical forces associated with the chamber;

liner means structurally independent of said frame and cooperating with the frame to define a combustion zone, said liner means including a plurality of continuous annular rings adjacent to each other;

means for positioning at least one of said rings including flexble means carried by said ring and retaining means for cooperating with said flexible means to retain said ring substantally within a predetermined position with respect to said frame during operation of the chamber, said retaining means including a protrusion and a detent for accepting the protrusion, said frame means having a spaced plurality of detents extending circumferentially of the frame means and said protrusion including a retaining band disposed within one of said detents and cooperating with one of said rings.

* * * * *